US008196792B2

(12) United States Patent
Clifton, Jr.

(10) Patent No.: US 8,196,792 B2
(45) Date of Patent: Jun. 12, 2012

(54) MOUNTING PLATE AND LEG HARNESS ASSEMBLY

(76) Inventor: Norman E. Clifton, Jr., Jacksonville, FL (US)

( * ) Notice: Subject to any disclaimer, the term of this patent is extended or adjusted under 35 U.S.C. 154(b) by 1104 days.

(21) Appl. No.: 11/028,340

(22) Filed: Jan. 3, 2005

(65) Prior Publication Data

US 2006/0144882 A1 Jul. 6, 2006

(51) Int. Cl.
*A45F 5/00* (2006.01)

(52) U.S. Cl. ..... 224/661; 224/678

(58) Field of Classification Search ..... 224/222, 224/661, 663, 665, 267, 219, 678, 232, 912
See application file for complete search history.

(56) References Cited

U.S. PATENT DOCUMENTS

D265,861 S * 8/1982 Walasek ..... D3/227
4,544,089 A * 10/1985 Tabler ..... 224/192
4,828,154 A * 5/1989 Clifton, Jr. ..... 224/661
4,953,767 A * 9/1990 Bennett ..... 224/192
5,056,696 A * 10/1991 Lahr ..... 224/148.4
5,768,816 A * 6/1998 Rassias ..... 42/70.11
6,149,042 A * 11/2000 Rassias ..... 224/661
6,547,118 B2 * 4/2003 Beletsky et al. ..... 224/661
6,685,066 B2 * 2/2004 Cragg ..... 224/192
6,926,182 B2 * 8/2005 Cragg ..... 224/238
7,320,420 B2 * 1/2008 Buis et al. ..... 224/197
2003/0205594 A1 * 11/2003 Rassias ..... 224/192
2004/0035900 A1 * 2/2004 Cragg ..... 224/661

* cited by examiner

*Primary Examiner* — Justin Larson

(57) ABSTRACT

A mounting plate and leg harness assembly for carrying holsterable items having a rigid center portion and vertically disposed sides and two spaced side panels integral with a respective side of the center portion, each side panel having an outside edge, a first pair of vertically spaced elongate slots located adjacent the center portion and a second pair of vertically spaced elongate slots located adjacent the outside edge. Two horizontally disposed straps are threaded through the respective upper and lower slots with the straps spanning the center portion. The side panels are bendable adjacent the respective sides of the center portion to conform the plate to the shape of the leg of a wearer when the straps are tightened. A vertical adjustable strap is mounted to the plate for connection to a belt.

12 Claims, 5 Drawing Sheets

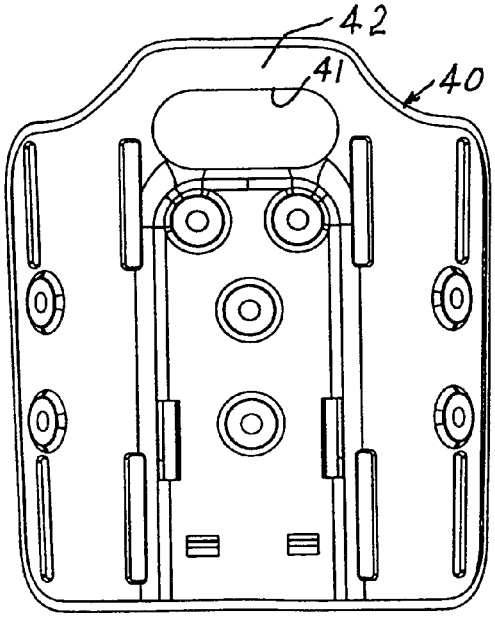
FIG. 12
FIG. 6
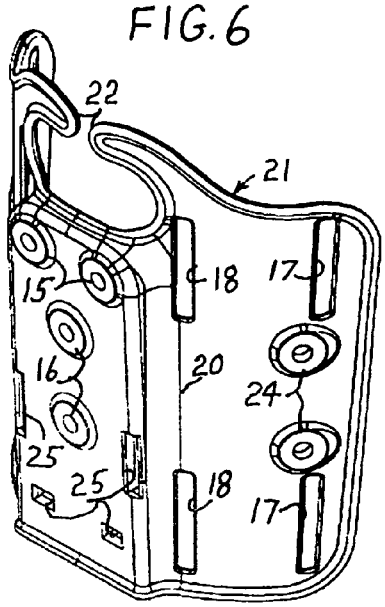
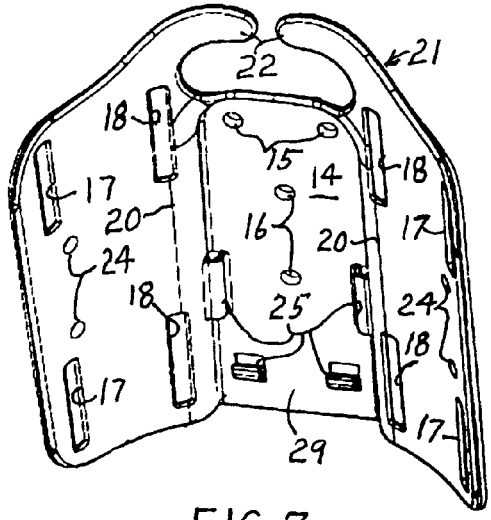
FIG. 7

MOUNTING PLATE AND LEG HARNESS ASSEMBLY

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to mounting plates for carrying holsterable items such as firearms and ammo clips and particularly to plates worn on the thigh of the user.

2. Relevant Art

There are a wide variety of gun holsters adapted to be worn on the leg and particularly on the thigh. What is desired is apparatus for holsterable items that is secure to the leg of the user and also more comfortable than devices known to the art. Moreover, through the use of a mounting plate, a wide variety of devices such as magazine pouches, flash-bang carriers, knife sheaths and the like. Finally the mounting plate should fit securely to the leg of a user, be comfortable, and be adaptable for use in wet or icy conditions.

BRIEF SUMMARY OF THE INVENTION

In one aspect of the present invention there is provided apparatus for securing holsterable items to the leg of a wearer comprising a vertically elongated mounting plate including a center panel having vertically disposed opposite side portions and two side panels, one side panel integrally and bendably attached along a vertical axis to one side portion of the center panel, another side panel integrally and bendably attached along another vertical axis to another side portion of the center panel. The side panels are arcuate in shape to conform to the shape of a leg of a wearer, and attaching means for removably securing the mounting plate to a leg of a wearer with the side panels snugly engaging a wearer's leg. Each side panel includes at least one elongate slot, the attaching means including at least one horizontally disposed strap having a first portion and a pair of spaced second portions threaded through each at least one elongate slot, the side panels being bendable adjacent respective the side portions to provide the plate generally conforming to the shape of the leg of a wearer. The side panels are curved to substantially conform to the shape of the leg of a wearer. Each panel includes an inner surface positionable adjacent the leg of a wearer and an outer surface and outside edge portions opposite the side edge portion. The strap is threaded through the slots to position the first portion of the strap adjacent the inner surface of the center panel. The strap is threaded through the slots to locate the pair of spaced second portions of the strap closely adjacent the outside edge portions to position each second portion of the strap between each edge portion and the leg of a wearer. Other aspects of the invention include an elongate vertical strap connected at one end to the center panel, releasable attaching means between one end of the strap and another end of the strap to provide a belt loop in a medial portion of the strap. The mounting plate has a passageway adjacent its upper end through which the vertical strap extends. The mounting plate portion above the passageway contacts the vertical strap and urges the vertical strap outwardly whereby a lower end of the mounting plate is urged inwardly.

Other aspects of the present invention include a vertical strap having upper and lower end portions and securing means for attaching the lower end portion of said vertical strap to the inner surface of the center panel, the first portion of the strap locatable between the lower portion of the vertical strap and the leg of a wearer. Each side panel includes an upper portion and a lower portion, the upper portion of each side panel including a resilient securing tab for engaging the vertical strap to force said upper portion of the vertical strap away from the body of a wearer.

In another aspect of the present invention, there is provided apparatus for securing holsterable items to a leg of a wearer comprising a vertically elongated mounting plate including a center panel having vertically disposed side portions and two spaced side panels integral with a respective side portion of the center panel, each side panel having an outside edge portion. Each side panel has a first pair of vertically spaced elongate slots located adjacent the center panel and a second pair of vertically spaced elongate slots located adjacent the outside edge portion. A first and second horizontally disposed strap is included, each strap having a first portion and a pair of spaced second portions, the first strap threaded through an upper first and second slot of each side panel, the second strap threaded through a lower first and second slot of each side panel. The side panels are bendable along a respective vertical axis adjacent respective side portions of the center panel to conform the plate to the shape of the leg of a wearer with the side panels snugly engaging a leg of a wearer when the straps are secured around such leg. The panels are curved to substantially conform to the shape of a leg of a wearer. Each panel includes an inner surface positionable adjacent the leg of a wearer and an outer surface and outside edge portions opposite the side edge portion. Each horizontal strap is threaded through respective slots to position the first portion of each horizontal strap adjacent the inner surface of the center panel. Each horizontal strap is threaded through respective slots to locate the pair of spaced second portions of each horizontal strap closely adjacent respective outside edge portions to position each second portion of each horizontal strap between the edge portions and the leg of a wearer. A vertical strap has upper and lower end portions and securing means for attaching the lower end portion of the vertical strap to the inner surface of the center panel, the first portion of each horizontal strap locatable between the lower portion of the vertical strap and the leg of a wearer. Each side panel includes an upper portion and a lower portion, the upper portion of each side panel including a resilient securing tab for engaging the vertical strap to force the upper portion of the vertical strap away from the body of a wearer.

In addition, the invention includes an elongate vertical strap connected at one end to the center panel, releasable attaching means between the one end of said strap and another end of the strap to provide a belt loop in a medial portion of the strap. The mounting plate has a passageway adjacent its upper end through which the vertical strap extends. The mounting plate portion above the passageway contacts the vertical strap and urges the vertical strap outwardly whereby a lower end of the mounting plate is urged inwardly.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

FIG. 6 is a perspective view of the outside surface of the plate of FIG. 1;

FIG. 7 is a perspective view of the inside of the plate of FIG. 1;

FIG. 12 is a front elevation of an alternate embodiment of the mounting plate.

DETAILED DESCRIPTION OF THE INVENTION

Figure 5:
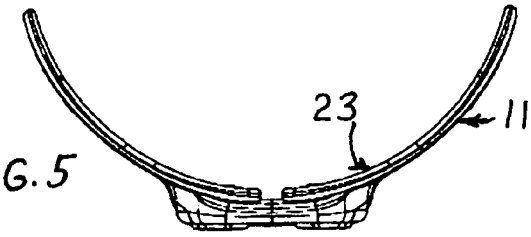
FIG. 5 is a top view of the plate of FIG. 1.
Figure 2:
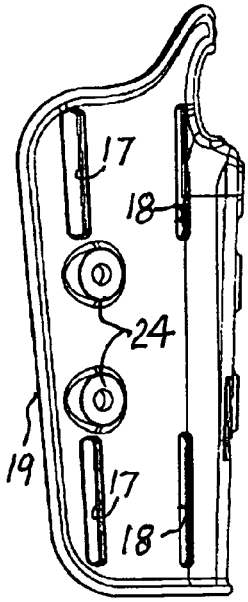
FIG. 2 is a side elevation view of the plate of FIG. 1.
Figure 1:
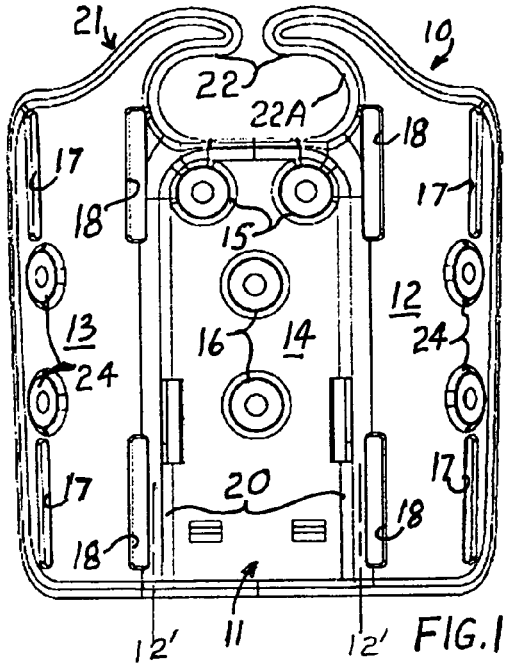
FIG. 1 is a front elevation view of the mounting plate used in the apparatus in accord with the present invention.
Figure 3:
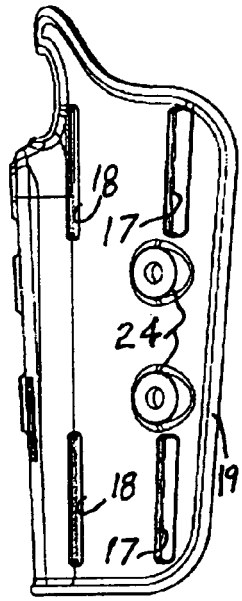
FIG. 3 is another side elevation view of the plate of FIG. 1.
Figure 4:
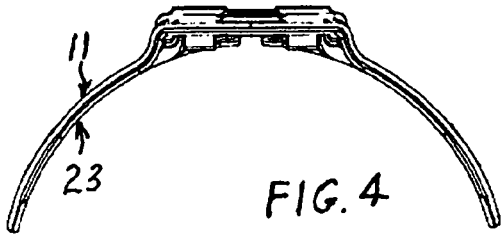
FIG. 4 is a bottom view of the plate of FIG. 1.

With respect now to the drawings, FIGS. 1-7 illustrates a front view of the mounting plate 10 showing outside surface 11. The plate 10 basically includes three portions: two side panels 12 and 13 which are mirror images of each other and respectively bendable along vertically disposed edge portions 20; and center panel 14. Center panel 14 has two horizontally disposed spaced screw base holes 15 and two vertically disposed spaced screw base holes 16 therebelow. Screw base holes 15 and lower hole 16 are employed to secure a harness 50 to the inside of the plate 10, as will be discussed hereinbelow. The plate 10 has an overall curved shape to substantially conform to the upper thigh of a user.

The curvature of plate 10 derives principally by curved side panels 12, 13 integrally formed with central panel 14. Each side panel 12, 13 includes two pairs of substantially vertically disposed slots, one pair 17 located adjacent the outside edge 18 of side panels 12, 13 and another pair 19 located inwardly and adjacent edge portions 20 of center panel 14. The spacing between the upper pair of slots 17 and 18 is larger than the lower pair of slots 17 and 18 on each of the side panels 12, 13.

The upper portion 21 of each side panel 12, 13 is formed as a securing tab 22 that is arcuate in shape and having a spring-like resilience biasing outwardly against a strap mounted against inside surface 23 of center panel 14 as will be discussed hereinbelow.

Each side panel 12, 13 includes a pair of vertically oriented screw bases 24 for use in attaching various accessories such as magazine carriers to plate 10. Allen wrench holders 25 provide a means of carrying standard L-shaped Allen wrenches to allow a user to change the attachments of various accessories and holsters of the plate 10 as desired.

Figure 8:
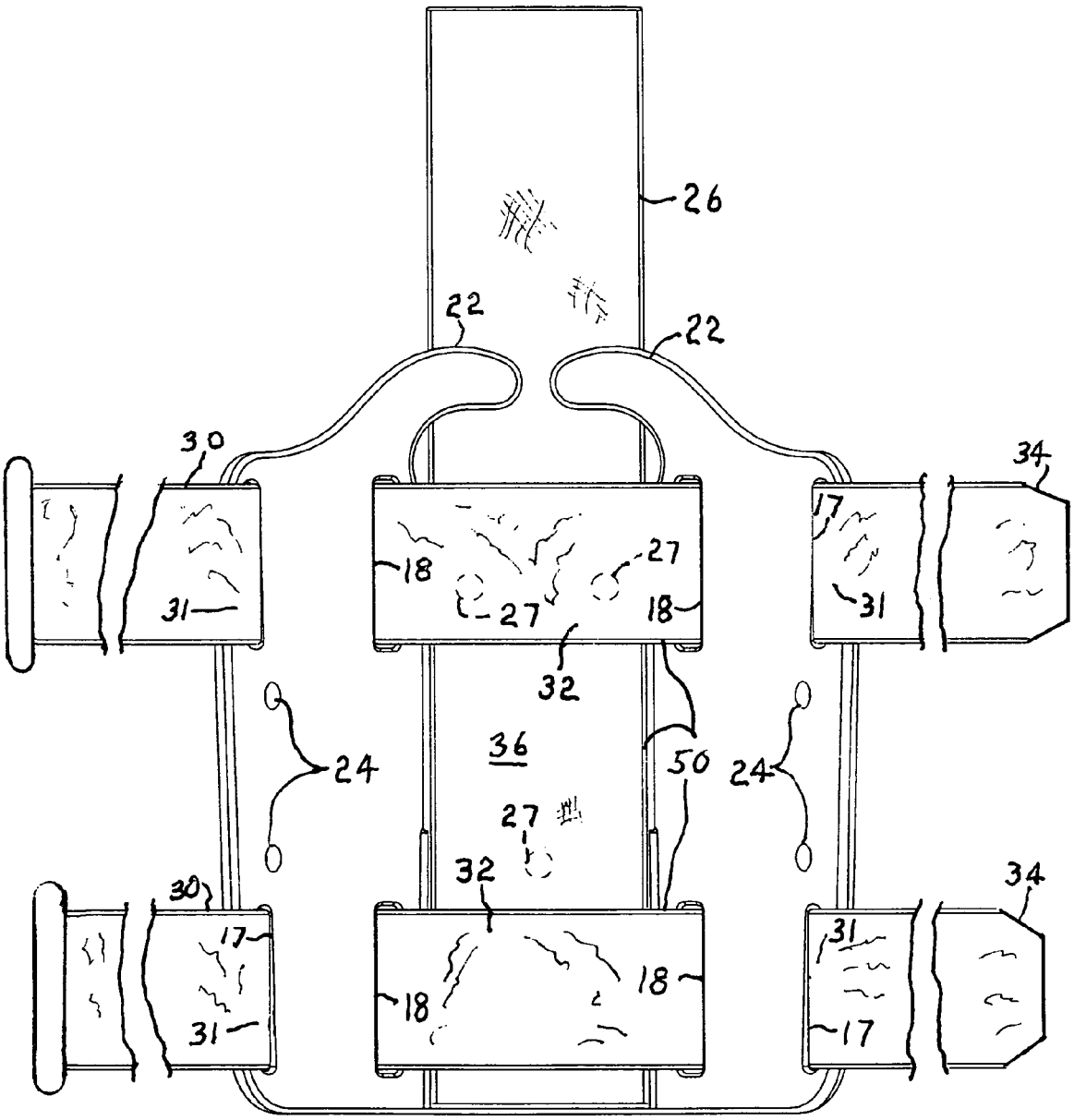
FIG. 8 is an inside view of the plate showing the harness straps in accord with the present invention used with the plate of FIG. 1.

FIG. 8 illustrates the vertical mounting strap 26 which is secured via Allen screws, including screw 27A (in FIG. 11), extending through spaced openings 27 in first length of strap 35 (shown in FIGS. 10 and 11), then through the inside surface 29 via holes 15 and the lower hole 16 in the center panel 14 of plate 10 and then into corresponding nuts (including nut 28 in FIG. 11) in holster 43 or the like. Vertical strap 26 is threaded on itself through tabs 22 and passageway 22A to force the upper portion of the plate 10 carrying a holster housing a handgun and other attached items in the desired position.

Horizontal straps 30 are threaded through slots 17 and 18 to place a portion of the straps 30 spanning between the panels 12, 13 against the leg of a user and between the edges 19 and a user to provide a comfortable and protected fit. The straps 30 overlie vertical strap 26 to force strap 26 against inside surface 29 of center panel 14 as clearly shown in FIG. 8. Straps 30 provide friction surfaces 31, 32 against the user to inhibit motion vertically and/or horizontally of the plate 10 and associated apparatus.

A harness 50 is formed by the mounting strap 26 and leg straps 30 to securely affix the back plate 10 to a user's leg and supported by strap 26 to a belt of a user or other vestment worn by a user adjacent the body of a user near the belt line of a user.

Figure 9:
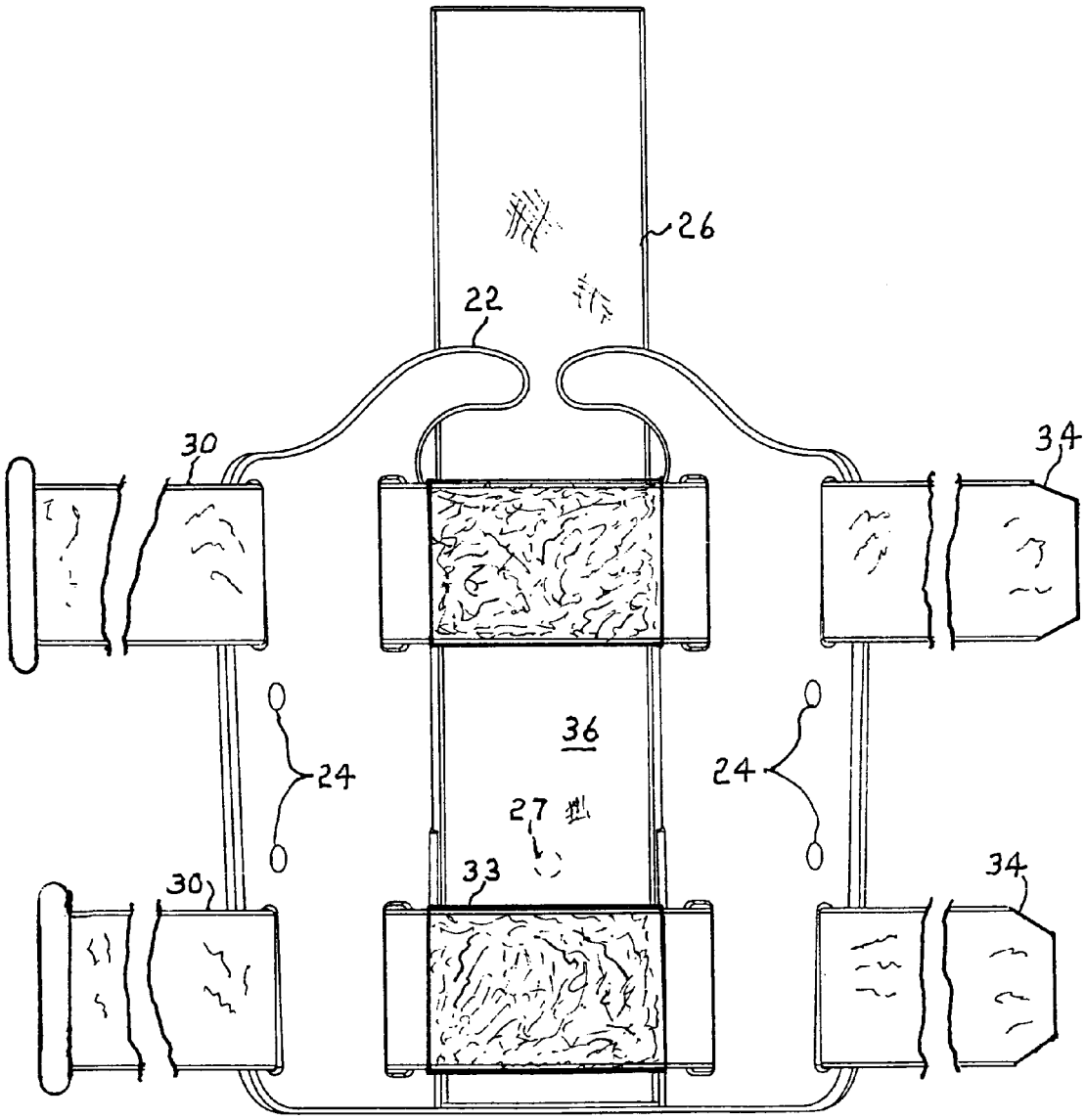
FIG. 9 is an inside view of the plate and harness utilizing optional rubber sleeves employed in wet and icy conditions.

FIG. 9 illustrates the use of rubber coated sleeves 33 installed over the inside straps forming enhanced friction surfaces for wet and/or icy environmental conditions. The straps 30 include standard snap buckles 34 that are well known in the art.

Figure 10:
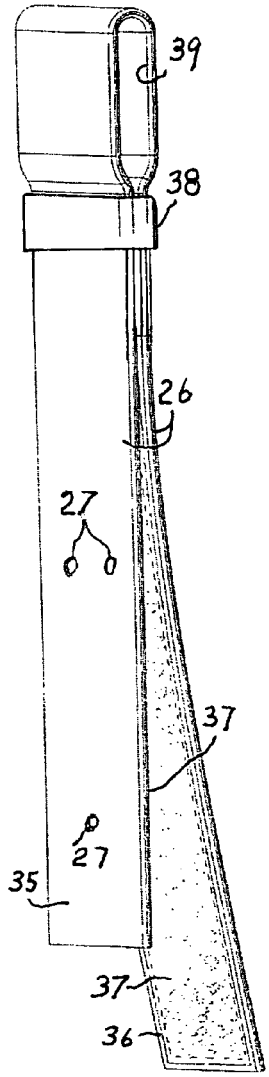
FIG. 10 is a detail of the vertical strap shown in FIGS. 8 and 9.

With respect to FIG. 10, a simplified view of vertical strap 26 is illustrated. Strap 26 is folded into a first length 35 and a second length 36, with fastener 37 preferably being interlocking fasteners such as Velcro. Length 36 carries the fluff and 35 carries the hooks of the interlocking fasteners 37, but these may be reversed as known in the art. A transverse strap 38 wrapped by the user around the upper portion of strap 26 after it has been looped around a user's belt. By threading horizontal straps 30 over vertical strap 26 pressure is applied from the user's leg against the vertical strap 26 to insure the first and second lengths 35, 36 stay secured together. This arrangement also covers screws, including screw 27A extending through holes 27 to prevent them from rubbing against the user.

Figure 11:
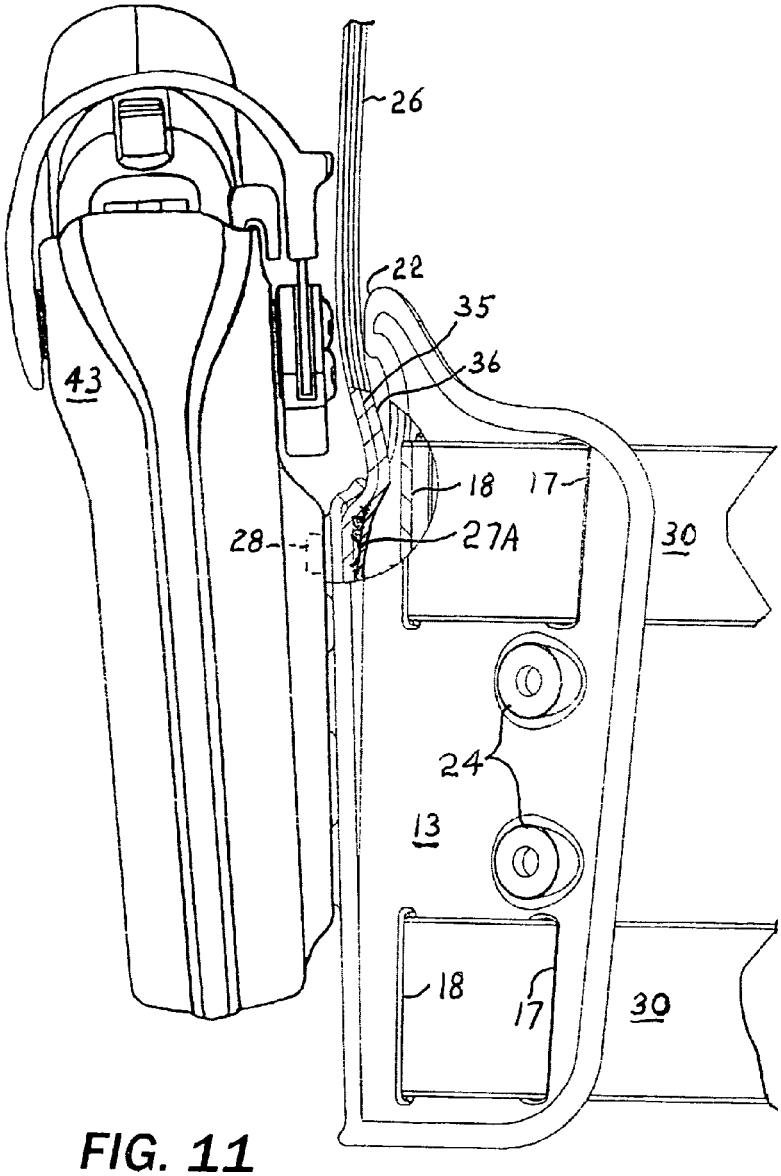
FIG. 11 is a detail of a side view of the vertical strap and shown in FIGS. 8-10.

FIG. 11 illustrates a front side view of the vertical strap 26 showing the urging by the tabs 22 of the belt 26 outwardly toward the holster 43 thereby positioning the holster 43 with the muzzle lower end urged toward the leg of a wearer and the upper end tilted slightly away from the user.

Bolt/screw holes 24 are used for mounting accessories such as magazine carriers and the like. Long bolts or screws, including screw 27A, used to secure strap 26 may be used through holes 15, 16 to mount a holster 43 for a firearm, as shown in FIG. 11.

With respect to FIG. 12, an alternate embodiment of a mounting plate 40 in accord with this invention is shown. Unlike the plate 10, tabs 22 are joined to form a band 42 extending between the two side panels of the plate defining a passageway 41 through which vertical strap 26 is threaded in a manner similar to that shown in FIGS. 8-11. Plate 40 is otherwise substantially identical to plate 10. The advantages of plate 10 over plate 40 include the ease of installation of the strap 26 into the passageway 22A by bending of tabs 22 whereas plate 40 requires threading of the strap 26 through passageway 41 to attach strap 26 to the belt of a user. The band 42 functions otherwise in the same manner as tabs 22.

Tabs 22 and band 42 are rigid members that may vary in thickness to contact and vary the biasing force against the upper portion of the holster 43 outwardly to appropriately position the holster 43 and plates 10 and 40 respectively. The tabs 22 and band 40 provide cooperative positioning and securing of the back plates 10, 40 with the strap 26 so that the lower portions of side panels 12 and 13 of the plates 10, 40 are properly positioned and secure the respective plates 10, 40 to a leg of a user.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed as new and what it is desired to secure by Letters Patent of the United States is:

1. Apparatus for securing holsterable items to a leg of a wearer, the apparatus comprising:

a mounting plate having an inner surface, oriented generally toward the leg, and an outer surface, oriented generally away from the leg, and including a central panel having a central portion and two generally parallel sloping edge portions and two curved side panels each extending outwardly from a respective one of the sloping edge portions, the central and side panels and sloping edge portions all being vertically elongated, the sloping edge portions sloping inwardly from the central portion then outwardly toward the side panels, and the side panels curving inwardly from the edge portions, each side panel including a first pair of slots with a first slot adjacent an outside edge of the side panel and a second slot adjacent the sloping edge portion of the central panel, each side panel also including an upper portion extending above the sloping edge portion of the central panel, the upper portions of the side panels forming a passageway above the central portion of the central panel;

an elongated vertical strap extending upwardly from the mounting plate and having a belt loop medially thereof, the vertical strap being secured inside the central portion of the central panel between the sloping edge portions and routed outside through the passageway;

a first horizontal strap extendable around the leg to releasable secure the mounting plate thereto and urge the side panels into conformance therewith, the first horizontal strap being routed inside the central panel behind the vertical strap, outside through the second slots outside the side panels and inside the first slots; and a first end of the vertical strap being secured to the central portion of the central panel, the vertical strap being looped over to form the belt loop and a second end of the vertical strap being routed inside through the passageway and behind the central panel and between the curved edge portions, the first horizontal strap running behind the first and second ends of the vertical strap ends.

2. The apparatus of claim 1 further comprising releasable means for connecting said second end of said vertical strap to said first end of said vertical strap.

3. The apparatus of claim 1 further comprising a second pair of spaced slots in each said side panels spaced vertically from said first and second slots of said first pairs of slots in each said side panels, a second horizontal strap generally parallel with the first horizontal strap and extendable around the leg to releasably secure the mounting plate thereto and urge the side panels into conformance therewith, the second horizontal strap being routed inside the central panel behind the vertical strap, outside through the second slots of the second pair, outside the side panels and inside the first slots of the second pair.

4. The apparatus of claim 1 wherein said mounting plate portion spaced away from and above said passageway contacts said vertical strap and urges said vertical strap outwardly and a lower end of said mounting plate being urged inwardly towards a wearer's leg.

5. The apparatus as defined in claim 1 wherein each said side panel includes an upper portion and a lower portion, said upper portion of each said side panel including a resilient securing tab forming said passageway for engaging said vertical strap spaced above contact between said vertical strap and said central panel to force said upper portion of said vertical strap away from a body of a wearer.

6. The apparatus of claim 1 wherein said releasable means are adjustable to permit the belt loop to be vertically adjusted with respect to the back plate.

7. The apparatus of claim 6 further comprising a plurality of spaced screw bases formed on the end panels for attaching accessories thereto.

8. The apparatus of claim 1 further comprising a holster connected outside the central panel by a plurality of fasteners inserted through the central portion of the central panel.

9. The apparatus of claim 8 wherein at least one of the plurality of fasteners also secures the first side end of vertical strap inside the central panel, the second side end of the vertical strap lying behind the plurality of fasteners.

10. The apparatus as defined in claim 1 wherein said vertical strap is formed of a first length and a second length, securing means for securing said first length of said vertical strap to said inner surface of said central panel, said second length of said vertical strap being folded to position said first and second lengths closely adjacent and substantially overlying each other, and fastening means between said first and second lengths for releasably securing lengths together.

11. The apparatus of claim 10 wherein said mounting plate portion spaced away from and above said passageway contacts said second length of said vertical strap outwardly and urges a lower end of said mounting plate inwardly towards a wearer's leg.

12. The assembly as defined in claim 10 wherein each said side panel includes an upper portion and a lower portion, said upper portion of each said side panel including a resilient securing tab forming said passageway for engaging said vertical strap to force said upper portion of said vertical strap away from a body of a wearer and a lower end of said mounting plate urged inwardly towards a wearer's leg.

* * * * *